US010087674B2

(12) United States Patent
Rochon et al.

(10) Patent No.: US 10,087,674 B2
(45) Date of Patent: Oct. 2, 2018

(54) CONCEALABLE FLUSH WALL DOOR STRUCTURAL FRAME AND FLUSH WALL DOOR ASSEMBLY INCLUDING SAME

(71) Applicant: INDUSTRIES DORR INC., Quebec (CA)

(72) Inventors: Daniel Rochon, Lac Beauport (CA); Mario Turcotte, St. Georges (CA); Steve Rochon, Lac Beauport (CA)

(73) Assignee: Industries Dorr Inc. (CA)

( * ) Notice: Subject to any disclaimer, the term of this patent is extended or adjusted under 35 U.S.C. 154(b) by 0 days.

(21) Appl. No.: 15/331,377

(22) Filed: Oct. 21, 2016

(65) Prior Publication Data

US 2017/0114587 A1 Apr. 27, 2017

Related U.S. Application Data

(60) Provisional application No. 62/244,486, filed on Oct. 21, 2015.

(51) Int. Cl.
*E06B 1/60* (2006.01)
*E06B 1/52* (2006.01)
(Continued)

(52) U.S. Cl.
CPC ..... *E06B 1/60* (2013.01); *E06B 1/12* (2013.01); *E06B 1/28* (2013.01); *E06B 1/52* (2013.01); *E06B 1/16* (2013.01)

(58) Field of Classification Search
CPC ..... E06B 1/60; E06B 1/28; E06B 1/30; E06B 1/12; E06B 1/52; E06B 1/16
(Continued)

(56) References Cited

U.S. PATENT DOCUMENTS 1,919,071 A * 7/1933 Mills ..... E06B 1/52 52/211
2,562,105 A * 7/1951 Lang ..... E06B 1/30 52/212

(Continued)

FOREIGN PATENT DOCUMENTS

EP 2312106 A1 4/2011

OTHER PUBLICATIONS

Küffner Aluzargen GmbH & Co. OHG, "Flush Doorframes", Germany, http://www.kueffner.de, 4 pgs.

*Primary Examiner* — Brian E Glessner
*Assistant Examiner* — Adam G Barlow
(74) *Attorney, Agent, or Firm* — Gardner Groff Greenwald & Villanueva, PC

(57) ABSTRACT

A concealable structural frame for mounting a hinged door flushed to a surface of a drywall structure. The concealable structural frame comprises a frame body including a stud facing wall, a door facing wall, a front surface wall, a rear surface wall, a stud engaging wall and a hinge engagement support. The door facing wall is spaced apart from the stud facing wall and includes a door receiving recess. The front surface wall and the rear surface walls are spaced apart and at least partially extend between the stud facing wall and the door facing wall. The stud engaging wall projects outwardly from the stud facing wall and defines a plasterboard receiving recess. The hinge engagement support is positioned between the stud facing wall and the door facing wall and extends along at least a portion of the door receiving recess.

23 Claims, 11 Drawing Sheets

(51) Int. Cl.
*E06B 1/12* (2006.01)
*E06B 1/28* (2006.01)
*E06B 1/16* (2006.01)

(58) Field of Classification Search
USPC ..... 52/211, 212, 213, 215, 656.4, 656.5; 49/504, 505
See application file for complete search history.

(56) References Cited

U.S. PATENT DOCUMENTS 2,913,777 A * 11/1959 Viets ..... E06B 1/20 49/380
2,925,894 A * 2/1960 Lee, Jr. ..... E06B 1/6015 16/236
3,324,599 A * 6/1967 Brost ..... E06B 1/20 49/505
3,345,780 A * 10/1967 McGhee ..... E06B 1/30 49/504
3,614,846 A * 10/1971 Donnelly et al. ..... E06B 1/08 52/213
3,654,731 A * 4/1972 Jellinek ..... E06B 1/6015 49/504
3,861,099 A * 1/1975 Faudree ..... E06B 1/18 52/211
4,005,558 A * 2/1977 Barrison ..... E06B 1/12 49/504
4,012,868 A * 3/1977 Andruszkiewicz ..... E06B 1/10 16/389
4,034,514 A * 7/1977 Cecil ..... E05D 5/04 49/504
4,179,849 A * 12/1979 Kuffner ..... E06B 1/603 49/505
4,223,494 A * 9/1980 Wendt ..... E06B 1/32 49/504
4,281,480 A * 8/1981 Wendt ..... E06B 1/34 49/504
4,443,984 A * 4/1984 Rasmussen ..... E06B 1/34 52/211
4,513,549 A * 4/1985 Wendt ..... E06B 3/9885 52/211
4,674,248 A * 6/1987 Hall ..... E06B 5/16 49/504
6,192,638 B1 * 2/2001 Wang ..... E06B 1/10 49/504
6,293,060 B1 * 9/2001 McKann ..... E06B 1/12 49/504
7,621,083 B2 * 11/2009 Smith ..... E06B 1/18 49/504
8,650,818 B1 * 2/2014 Smith ..... E06B 1/52 52/211
9,416,580 B2 8/2016 Stevens et al.
2006/0048466 A1 * 3/2006 Darnell ..... E06B 1/32 52/204.1
2009/0241465 A1 * 10/2009 Majors ..... E06B 1/30 52/784.11
2013/0219813 A1 * 8/2013 Gadoury ..... E06B 1/045 52/211
2014/0069038 A1 * 3/2014 Back ..... E06B 1/52 52/210

* cited by examiner

CONCEALABLE FLUSH WALL DOOR STRUCTURAL FRAME AND FLUSH WALL DOOR ASSEMBLY INCLUDING SAME

CROSS REFERENCE TO RELATED APPLICATION

This application claims the benefit under 35 U.S.C. § 119(e) of U.S. provisional patent application no. 62/244,486 which was filed on Oct. 21, 2015. The entirety of the aforementioned application is herein incorporated by reference.

TECHNICAL FIELD OF THE INVENTION

The present invention relates to the field of flush wall hinged doors. More particularly, it relates to a concealable structural frame for mounting a hinged door substantially flushed to a drywall structure and an assembly including the structural frame for performing the same.

BACKGROUND

Hinged-type doors are commonly found in all types of buildings, to allow selective opening and closing of void wall sections. In most cases, mounting assemblies for such hinged-type doors include a door jamb affixed to the wall at the edges of the corresponding void section of the wall structure and a door pivotally mounted to the door jamb using hinges.

In some instances, it is however desired that the hinged-type door be of the flush wall type (i.e. a door that is substantially evenly levelled with one of the wall surface and consequently has a concealed appearance within the wall), therefore requiring that the mounting assembly includes no visible frame, jambs, or the like. Such flush wall doors are increasingly popular in residential and commercial buildings, due, for example, to the aesthetic benefits that they offer.

However known frames or frame assemblies for mounting a flush wall door to a wall structure tend to suffer from several drawbacks. For example and without being limitative, known frames or frame assemblies for flush wall hinged doors often tend to present visible gaps (i.e. gaps being wide enough to be easily noticeable) between the door and the wall surface, thereby negatively impacting the intended concealed appearance of the door. Moreover, the structure of known frames often leads to the plastering material (which can be applied onto the frame in order to conceal the frame and achieve the desired flush door look) being prone to cracking, thereby again negatively impacting the overall aesthetic of the assembly. Finally, known frames are often not structural in nature, thereby requiring the peripheral structure onto which the frame is mounted to be able to support the load of the door assembly, rather than the frame being able to support the load on its own.

In view of the above, there is a need for an improved structural frame and corresponding assembly for mounting a hinged door substantially flush with a drywall structure which, by virtue of its design and components, would be able to overcome or at least minimize some of the above-discussed prior art concerns.

BRIEF SUMMARY OF THE INVENTION

In accordance with a first general aspect, there is provided a concealable structural frame for mounting a hinged door flushed to a surface of a drywall structure including a wall stud and plasterboards having a thickness. The concealable structural frame comprises a frame body including a stud facing wall, a door facing wall, a front surface wall, a rear surface wall, a stud engaging wall and a hinge engagement support. The stud facing wall has an outwardly facing surface engageable with a surface of the stud. The door facing wall is spaced apart from the stud facing wall and includes a door receiving recess at least partially defined by a section of the door facing wall. The front surface wall at least partially extends between the stud facing wall and the door facing wall and is configured to receive a plaster layer thereon, for concealment thereof. The rear surface wall at least partially extends between the stud facing wall and the door facing wall and is spaced apart from the front surface wall. The stud engaging wall projects outwardly from the outwardly facing surface of the stud facing wall and is recessed inwardly from one of the front surface wall and the rear surface wall by a distance substantially similar to the thickness of the plasterboards to define a plasterboard receiving recess. The hinge engagement support is engageable with a hinge of the hinged door for supporting the hinge when the hinge is secured thereto. The hinge engagement support is positioned between the stud facing wall and the door facing wall and extends along at least a portion of the door receiving recess of the door facing wall.

In accordance with another general aspect, there is also provided a flush wall door assembly for mounting a hinged door flushed to a surface of a drywall structure including a wall stud and plasterboards having a thickness. The flush wall door assembly comprises a frame body including a stud facing wall, a door facing wall, a front surface wall, a rear surface wall, a stud engaging wall and a hinge engagement support. The stud facing wall has an outwardly facing surface engageable with a surface of the stud. The door facing wall is spaced apart from the stud facing wall and includes a door receiving recess at least partially defined by a section of the door facing wall. The front surface wall at least partially extends between the stud facing wall and the door facing wall and is configured to receive a plaster layer thereon, for concealment thereof. The rear surface wall at least partially extends between the stud facing wall and the door facing wall and is spaced apart from the front surface wall. The stud engaging wall projects outwardly from the outwardly facing surface of the stud facing wall and is recessed inwardly from one of the front surface wall and the rear surface wall by a distance substantially similar to the thickness of the plasterboards to define a plasterboard receiving recess. The hinge engagement support is positioned between the stud facing wall and the door facing wall and extends along at least a portion of the door receiving recess of the door facing wall. The flush wall door assembly also comprises a door hingedly connectable to the door facing wall of the frame body, along the door receiving recess and concealed type hinges engageable between the door and the frame body. The concealed type hinges are securable to the hinge engagement support of the frame body and are supported by the hinge engagement support of the frame body when secured thereto.

In an embodiment, the frame body comprises a hinge side structural frame section, a latch side structural frame section spaced apart from the hinge side structural frame section and a top structural frame section connecting the hinge side structural frame section and the latch side structural frame section at a top end thereof.

In an embodiment, the front surface wall comprises a door adjacent section and a stud adjacent section inwardly recessed with respect to the door adjacent section. The stud adjacent section is positioned closer to the stud engaging wall than the door adjacent section.

In an embodiment, the front surface wall includes a front lip extending outwardly at a distal end thereof.

In an embodiment, the frame body comprises two stud engaging walls spaced apart from one another of a distance substantially similar to the width of the stud, each one of the two stud engaging walls being recessed inwardly from a corresponding one of the front surface wall and the rear surface wall by a distance substantially similar to the thickness of the plasterboards to define a plasterboard receiving recess. At least one of the two stud engaging walls is removably connectable to the frame body.

In an embodiment, the at least one stud engaging wall removably connectable to the frame body includes a connecting end engageable to the stud facing wall, in a pivoting male-female configuration.

In an embodiment, the frame body comprises at least one engagement channel defined in the stud facing wall thereof. The at least one engagement channel and the connecting end of the at least one stud engaging wall removably connectable to the frame body have a complementary hook profile for each one of the at least one engagement channel to receive and securely engage the connecting end of a corresponding one of the at least one removably connectable stud engaging wall.

In an embodiment, the rear surface wall is configured to receive a plaster layer thereon, for concealment thereof.

In an embodiment, the rear surface wall comprises a door adjacent section and a stud adjacent section inwardly recessed with respect to the door adjacent section, the stud adjacent section being positioned closer to the stud engaging wall than the door adjacent section.

In an embodiment, at least one of the front surface wall and the rear surface wall comprises a serrated outer surface.

In an embodiment, the rear surface wall includes a rear lip extending outwardly at a distal end thereof.

In an embodiment, the stud facing wall comprises an inwardly facing surface and the frame body further comprises a plasterboard receiving cavity configured to receive a portion of one of the plasterboards lining the stud facing wall along the inwardly facing surface thereof.

In an embodiment, the frame body further comprises a rear projection projecting outwardly from a rear surface of the rear surface wall and spaced apart from the stud facing wall of a distance substantially similar to the thickness of the one of the plasterboards lining the stud facing wall along the inwardly facing surface. The plasterboard receiving cavity is defined by a combination of a portion of the stud facing wall, a portion of the rear surface wall and the rear projection.

BRIEF DESCRIPTION OF THE DRAWINGS

Other objects, advantages and features will become more apparent upon reading the following non-restrictive description of embodiments thereof, given for the purpose of exemplification only, with reference to the accompanying drawings in which.

DETAILED DESCRIPTION

In the following description, the same numerical references refer to similar elements. The embodiments, geometrical configurations, materials mentioned and/or dimensions shown in the figures or described in the present description are embodiments only, given solely for exemplification purposes.

Moreover, although the embodiments of the concealable flush wall door structural frame and structural frame assembly for a flush wall door and corresponding parts thereof consist of certain geometrical configurations as explained and illustrated herein, not all of these components and geometries are essential and thus should not be taken in their restrictive sense. It is to be understood, as also apparent to a person skilled in the art, that other suitable components and cooperation thereinbetween, as well as other suitable geometrical configurations, may be used for the concealable frame and frame assembly for a flush wall door, as will be briefly explained herein and as can be easily inferred herefrom by a person skilled in the art. Moreover, it will be appreciated that positional descriptions such as "above", "below", "left", "right" and the like should, unless otherwise indicated, be taken in the context of the figures and should not be considered limiting.

Figure 1:
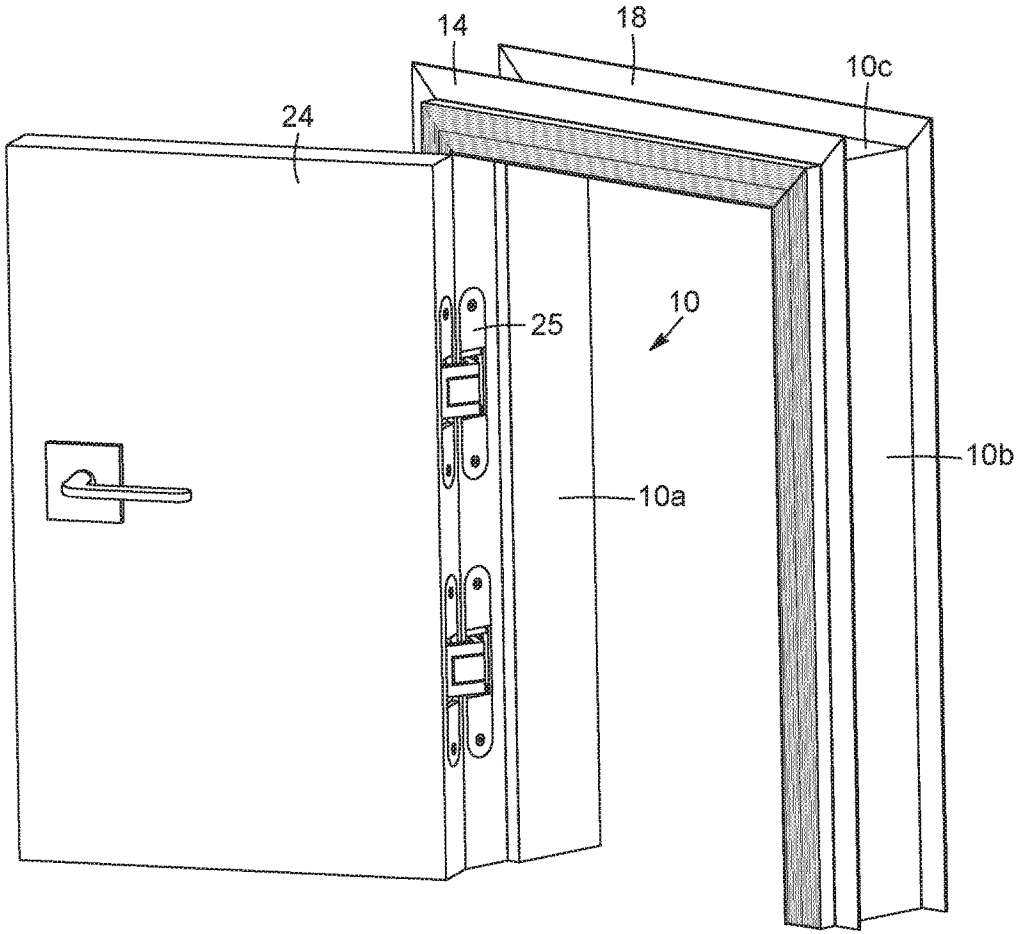
FIG. 1 is a perspective view of a concealable structural frame, shown with a hinged door connected thereto, in an open configuration, in accordance with an embodiment where the concealable structural frame includes stud engaging walls spaced apart from one another and where the door opens outwardly.
Figure 2:
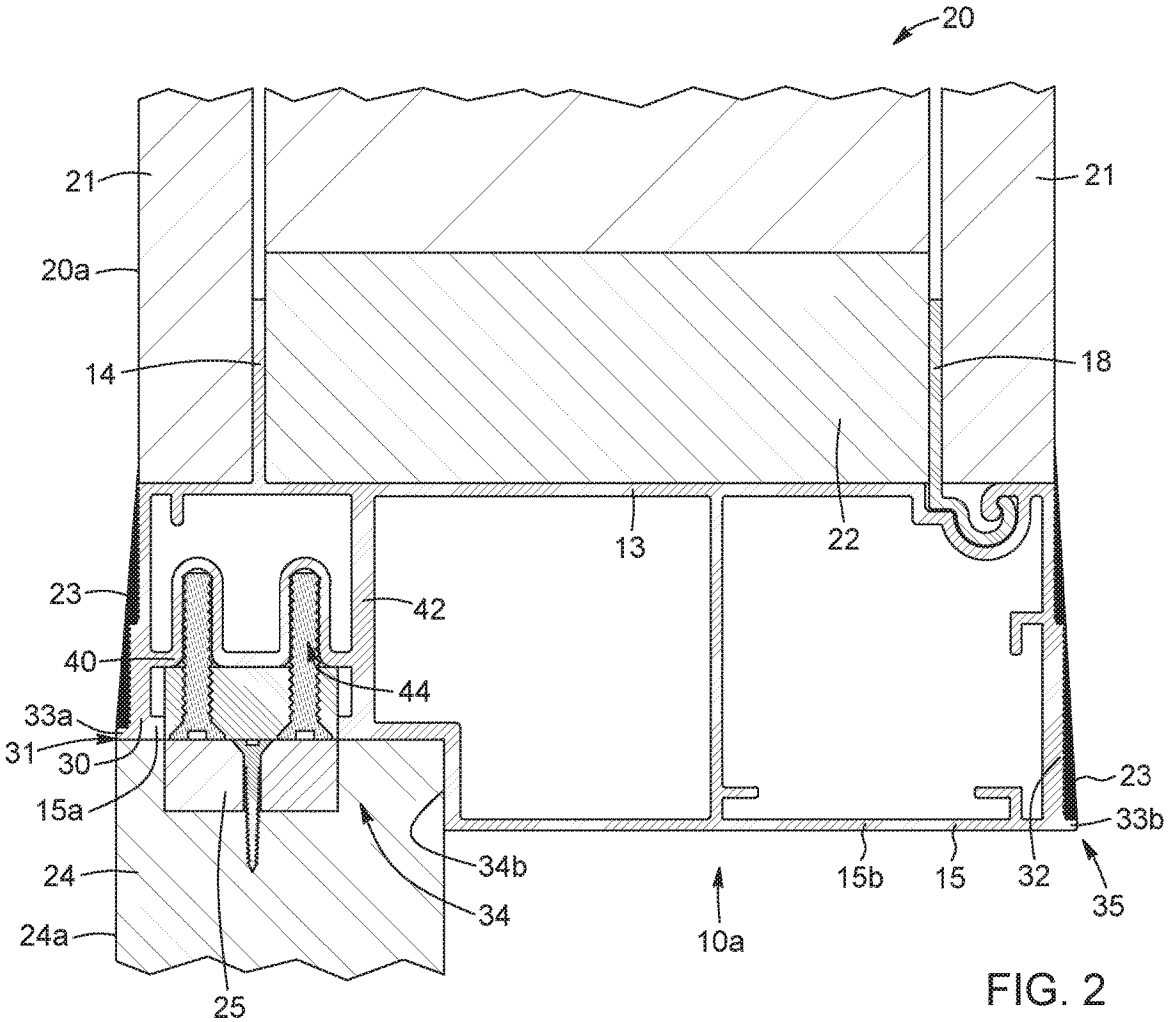
FIG. 2 is a cross-sectional view of a hinge side structural frame section of the concealable structural frame of FIG. 1, shown mounted to a wall structure and with the hinged door connected thereto, in a closed configuration.

Referring generally to FIGS. 1 and 2, there is provided a concealable structural frame 10 for mounting a hinged door 24 substantially flush to a drywall structure 20, in accordance with an embodiment. The drywall structure 20 includes studs 22 and plasterboards 21. One of the plasterboards 21 defines a front surface 20*a* of the drywall structure 20 (i.e. the surface of the wall structure 20 that is substantially flush with the hinged door 24 when the hinged door 24 is configured in a closed configuration. In the embodiment shown in FIGS. 1 and 2, the concealable structural frame 10 is configured for the hinged door 24 to open (or pivot) towards the outside (i.e. through a user pulling on the hinged door 24 from the front surface 20*a* of the drywall structure 20), but one skilled in the art will understand that in alternative embodiments (see FIGS. 6 and 7 for example), the concealable structural frame 10 can be configured for the hinged door 24 to open towards the inside.

One skilled in the art will understand that the concealable structural frame 10 is designed to be part of a flush wall door assembly including the structural frame 10, the door 24 hingedly connectable to the structural frame and concealed-type hinges 25, for mounting the door 24 to the concealable structural frame 10. In FIG. 2, the door 24 is shown in an open configuration, but it is appreciated that the door 24 can be pivoted towards a closed configuration (see FIG. 2).

It will be understood that, in order to provide the hinged door 24 substantially flush to the drywall structure 20, the concealable frame 10 includes at least three structural frame 10 sections to engage and support the flush wall door 24. As can be seen in FIG. 1, a first frame section 10*a* engages the door 24 on the hinge side (i.e. a hinge side structural frame section 10*a*) and a second frame section engages the door 24 on the latch side (i.e. a latch side structural frame section 10*b*). It will be understood that the hinge side structural frame section 10*a* and latch side structural frame section 10*b* present similar characteristics, the two structural frame sections 10*a*, 10*b* being spaced apart from one another and positioned in a mirror configuration to engage the respective edges of the door 24 when mounted to the drywall structure 20. As can be further seen in FIG. 1, in an embodiment, the frame 10 further includes a top structural frame section 10*c* extending between the hinge side structural frame section 10*a* and latch side structural frame section 10*b*, at an upper end thereof, to engage the door 24 at the upper end. The top structural frame section 10*c* is engaged to the hinge side structural frame section 10*a* and latch side structural frame section 10*b*, at an upper end thereof, thereby connecting the hinge side structural frame section 10*a* and latch side structural frame section 10*b* at the upper end thereof. Once again, the top structural frame section 10*c* presents similar characteristics as the hinge side structural frame section 10*a* and latch side structural frame section 10*b*. FIG. 1 shows the concealable structural frame 10 including the combination of the latch side structural frame section 10*b*, hinge side structural frame section 10*a* and top structural frame section 10*c*.

It will be understood that the length of the inner portion of the hinge side structural frame section 10*a* and latch side structural frame section 10*b* of the concealable structural frame 10 is substantially similar to a height of the flush wall door 24. Moreover, the length of the inner portion of the top structural frame section 10*c* of the concealable structural frame 10 is substantially similar to a width of the flush wall door 24.

One skilled in the art will understand that the latch side structural frame section 10*b*, hinge side structural frame section 10*a* and top structural frame section 10*c* can be joined to one another using conventional means or method such as welding, brazing or the like, in order to define the concealable structural frame 10. As can be seen in the embodiment of FIG. 2, in an embodiment, the upper end of the hinge side structural frame section 10*a* and the latch side structural frame section 10*b* of the concealable structural frame 10, as well as the opposed ends of the top structural frame section 10*c* can also include complementary angled edges, in order to define the corners of the concealable structural frame 10.

The concealable structural frame 10 is made of rigid material providing sufficient rigidity and strength to provide structural properties to the frame 10, i.e. the frame 10 has sufficient strength to support the hinged door 24 and hinges 25 on its own, without having to rely on the strength of the drywall structure 20. The material of the structural frame 10 is also compatible with plastering material applicable thereon in order to substantially conceal the structural frame 10 in the drywall structure 20, as will be described in more details below. In an embodiment, the concealable structural frame 10 is made of extruded aluminum, but one skilled in the art will understand that, in alternative embodiments, other materials such as steel, rigid polymeric material or the like can also be used.

In order to ease the present description, the description of the components of the concealable structural frame 10 provided below will focus on the hinge side structural frame section 10*a*, but one skilled in the art will understand that the teachings of the present description substantially apply to the latch side structural frame section 10*b* and top structural frame section 10*c* as well. Indeed, unless possible variations are specifically addressed in the description below, the hinge side structural frame section 10*a*, latch side structural frame section 10*b* and top structural frame section 10*c* should be presumed to present substantially similar elements and configurations.

Referring now to FIGS. 2 to 5, in the embodiment shown, the concealable structural frame 10 includes a frame body 12 with a stud facing wall 13, a door facing wall 15, spaced-apart from the stud facing wall 13, and two stud engaging walls 14, 18. In this embodiment, the two stud engaging walls 14, 18 are spaced-apart from one another and extend outwardly from an outwardly facing surface 13*a* of the stud facing wall 13. The frame body 12 further includes front and rear surface walls 30, 32. In the embodiment shown, the front and rear surface walls 30, 32 are positioned at opposed lateral ends of the structural frame 10 (i.e. at opposed ends of the stud facing wall 13 and door facing wall 15) and extend between the stud facing wall 13 and the door facing wall 15. The front surface wall 30 is the wall of the body 12 that is substantially aligned with a front surface 24*a* of the door 24 engaged to the concealable structural frame 10, when the door 24 is configured in the closed configuration.

In the embodiment shown, the first one of the stud engaging wall 14 is a fixed stud engaging wall (i.e. a stud engaging wall permanently mounted to the stud facing wall 13 of the concealable structural frame 10 or being integral therewith). The second one 18 of the stud engaging wall is a removable stud engaging wall (i.e. a stud engaging wall selectively engageable with, and disengageable from, the stud facing wall 13). More particularly, in the embodiment shown, the frame body 12 includes an engagement channel 16 (see FIG. 4) defined in the stud facing wall 13. The engagement channel 16 is sized and shaped to receive therein a complementary connecting end 18*a* (See FIG. 5) of the removable stud engaging wall 18 engageable with the frame body 12, in a pivoting male-female configuration.

Figure 3:
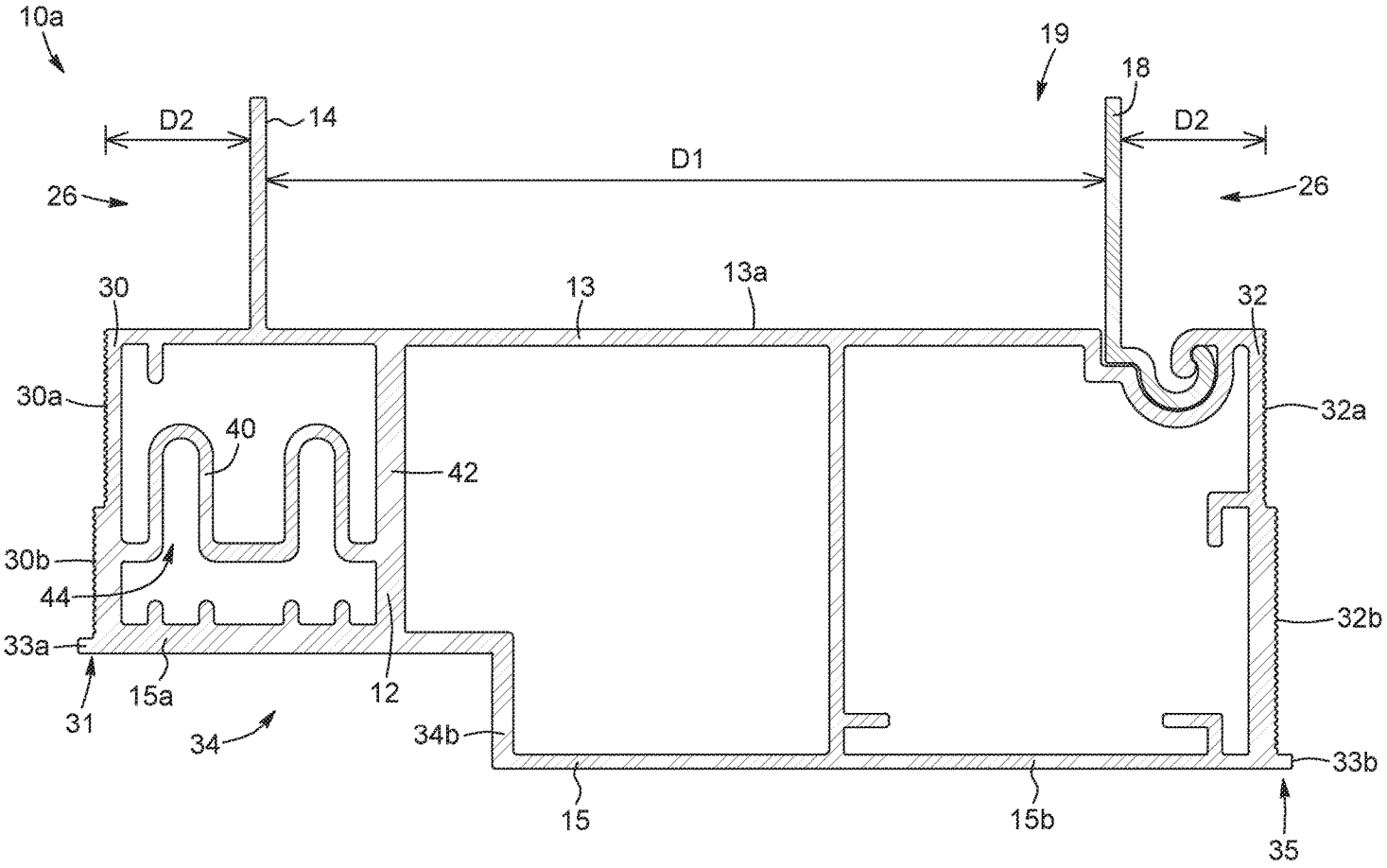
FIG. 3 is a cross-sectional view of the hinge side structural frame section of the concealable structural frame of FIG. 2.
Figure 4:
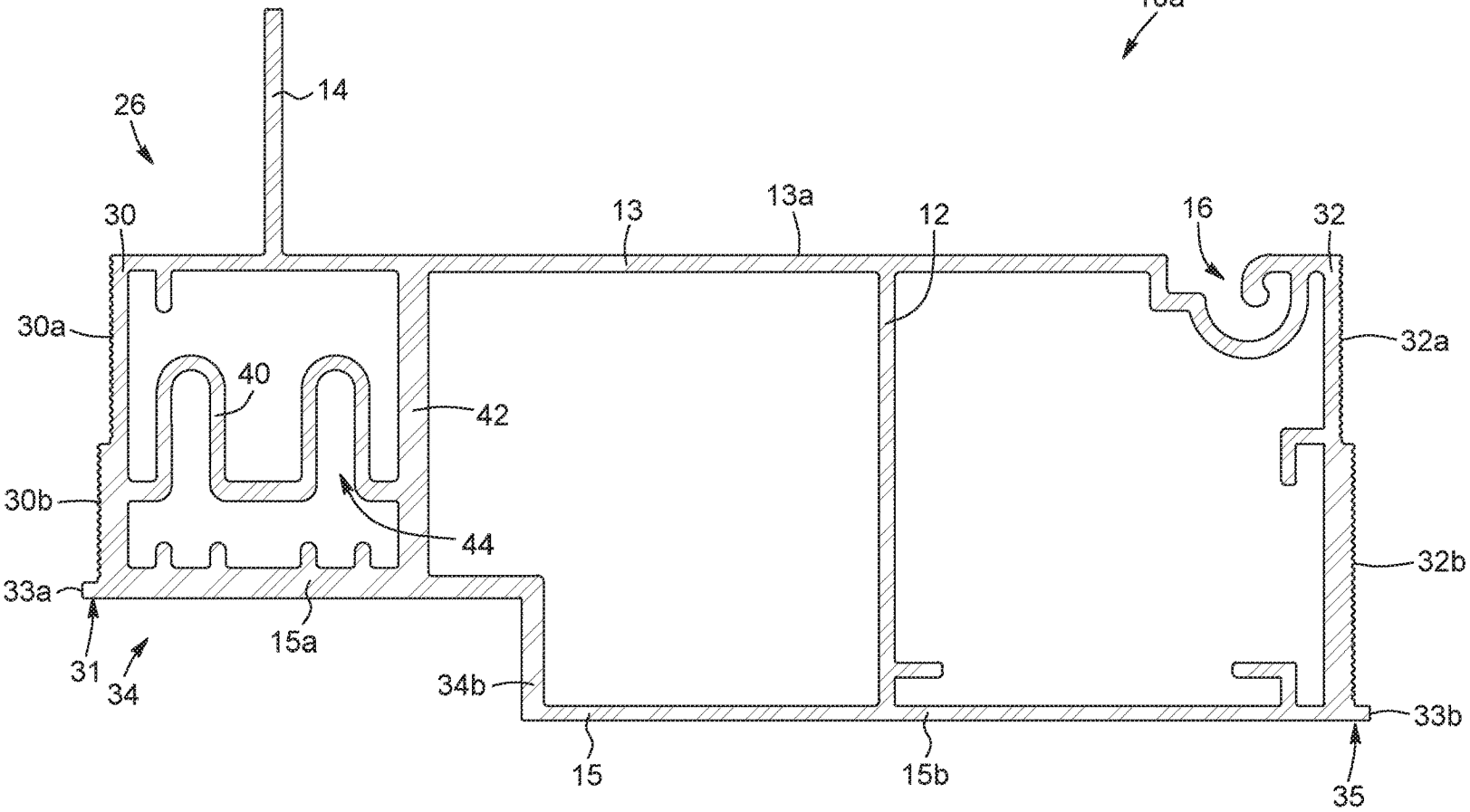
FIG. 4 is a cross-sectional view of the hinge side structural frame section of the concealable structural frame of FIG. 2, shown with the removable stud engaging wall removed therefrom.
Figure 5:
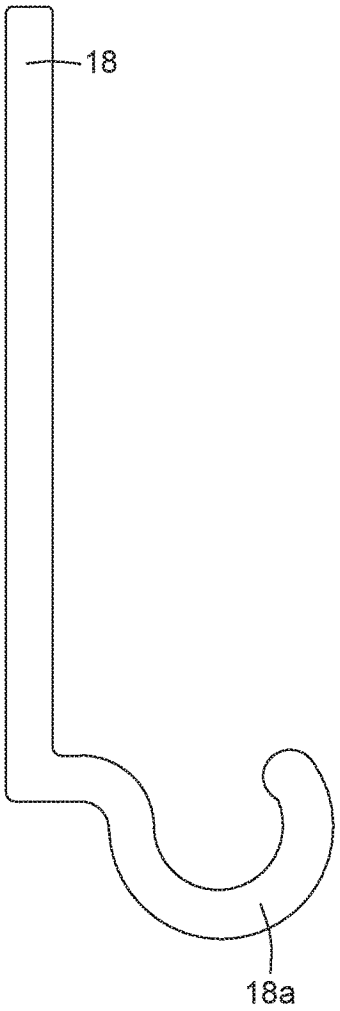
FIG. 5 is a front elevation view of a removable stud engaging wall of the concealable structural frame of FIG. 1, shown removed from the structural frame.

Referring to FIGS. 4 and 5, in the embodiment shown, the connecting channel 16 has a hooked inner profile and the connecting end 18*a* of the removable stud engaging wall 18 has a complementary hook profile to allow pivotal insertion of the connecting end 18*a* of the removable stud engaging wall 18 in the connecting channel 16 of the frame body 12, for selective engagement of the removable stud engaging wall 18 with the frame body 12, as will be described in more details below. Hence, the removable stud engaging wall 18 can be selectively engaged to the frame body 12 (see FIGS. 2 and 3) and disengaged therefrom (See FIG. 4) by inserting the connecting end 18*a* of the removable stud engaging wall 18 in the connecting channel 16 and pivoting the removable stud engaging wall 18. In the embodiment shown, the removable stud engaging wall 18, is pivoted inwardly when the removable stud engaging wall 18 is engaged to the frame body 12 (i.e. the removable stud engaging wall 18 is pivoted towards the fixed stud engaging wall 14 or engaging the removable stud engaging wall 18 to the frame body 12).

One skilled in the art will understand that such engagement/disengagement of the removable stud engaging wall 18 from the frame body 12, allows a concealable structural frame 10 including a combination of the latch side structural frame section 10*b*, hinge side structural frame section 10*a* and top structural frame section 10*c* mounted to one another, to be inserted in an aperture of a prefabricated wall structure 20 (without the plasterboards 21) and secured thereto. Indeed, in such an embodiment, when the removable stud engaging wall 18 is disengaged from the frame body 12, the concealable structural frame 10 can be inserted into the aperture in the wall structure 20, from one side, until the fixed stud engaging wall 14 and the stud facing wall 13 (i.e. the outwardly facing surface 13*a* thereof) each engage a surface of the stud 22 of the wall structure 20. In an embodiment, the fixed stud engaging wall 14 can be fastened to the stud 22 of the wall structure 20, using known fasteners such as, nails, screws, or the like. Subsequently, the removable stud engaging wall 18 can be engaged to the frame body 12 and engaged to a surface of the stud 22 of the wall structure 20 opposed to the one engaged by the fixed stud engaging wall 14. In an embodiment, the removable stud engaging wall 18 can also be fastened to the stud 22 of the wall structure 20, using known fasteners such as, nails, screws, or the like. Subsequently, and as will be described in more details below, the plasterboards 21 can be installed to cover the fixed stud engaging wall 14 and the removable stud engaging wall 18.

In the embodiment shown, once the removable stud engaging wall 18 is fastened (or secured) to the corresponding stud 22, using the above mentioned fastener, the removable stud engaging wall 18 can no longer be pivoted with respect to the frame body 12 and is therefore securely engaged therewith.

One skilled in the art will understand that, in an embodiment (not shown), the fixed stud engaging wall 14 and/or the removable stud engaging wall 18 can be discontinuous (i.e. the fixed stud engaging wall 14 and/or the removable stud engaging wall 18 can extend along only portions of the concealable structural frame 10). For example and without being limitative, in an embodiment, a plurality of sections of the removable stud engaging wall 18 can be engaged to the frame body 12 and engaged to the surface of the stud 22 of the wall structure 20 opposed to the one engaged by the fixed stud engaging wall 14.

In an alternative embodiment (not shown), the fixed stud engaging wall 14 and the removable stud engaging wall 18 can be inverted (i.e. the removable stud engaging wall 18 could be the stud engaging wall closest to the front surface 20*a* of the wall structure 20). In another alternative embodiment, the fixed stud engaging wall 14 can be replaced by a second removable stud engaging wall and connecting channel assembly. In such an embodiment, the two removable stud engaging walls would, once again, be spaced apart from one another of a distance substantially similar to the width of the studs 22 of the wall structure 20 to which the structural frame 10 is to be mounted, when engaged to the frame body 12.

In the embodiment shown, when the removable stud engaging wall 18 is engaged to the frame body 12 of the structural frame 10 (see FIGS. 2 and 3), the fixed stud engaging wall 14 and the removable stud engaging wall 18 are spaced apart from one another and define a stud engaging channel 19 inbetween. More particularly, the fixed stud engaging wall 14 and removable stud engaging wall 18 are spaced apart from one another of a distance D1 substantially similar to the width of the stud 22 of the wall structure 20 to which the structural frame 10 is to be mounted.

In the embodiment shown in FIGS. 1 to 4, each one of the stud engaging walls 14, 18 is spaced apart (or recessed inwardly) from the corresponding one of the front and rear surface walls 30, 32 of a distance D2 substantially similar to the thickness of the plasterboards 21 of the wall structure 20, thereby defining a front and a rear plasterboard receiving recesses 26 respectively. In an embodiment (not shown), each one of the stud engaging walls 14, 18 can be spaced apart from the corresponding one of the surface walls 30, 32 of a distance slightly narrower than the thickness of the plasterboards 21 of the wall structure 20, such that the corresponding plasterboard 21 extends outwardly from the corresponding surface walls 30, 32 of the frame body 12 of a slight distance.

As mentioned above, in an embodiment, in order to secure the structural frame 10 to the wall structure 20, the stud engaging walls 14, 18 are secured to the stud 22 by insertion of fasteners (not shown), such as nails, screws or the like, extending through the respective one of the stud engaging walls 14, 18 and into the stud 22. One skilled in the art will understand that, in an embodiment, the fasteners can extend through only the respective one of the stud engaging walls 14, 18 and the stud 22. In such an embodiment, the plasterboards 21 can be secured to the corresponding studs directly, outside of the stud engaging walls 14, 18 and using additional fasteners (not shown), such that the section of the plasterboard 21 is firmly pressed against the corresponding one of the stud engaging walls 14, 18. In an alternative embodiment (not shown), the fasteners can extend through the plasterboard 21, the respective one of the stud engaging walls 14, 18 and the stud 22.

Referring to FIG. 2, in order to provide the desired flush wall appearance of the combined wall structure 20, structural frame 10 and door 24, along the front surface 20*a* of the wall structure 20 and the front surface 24*a* of the door 24, the structural frame 10 is configured to receive a plaster layer 23 over the front surface wall 30. The plaster layer 23 provides a smooth transition between the plasterboard 21 and the distal end 31 of the front surface wall 30 (i.e. the end of the front surface wall 30 distal from the stud facing wall 13 of the frame body 12). In the embodiment shown, the concealable structural frame 10 is also configured to receive a plaster layer 23 over the rear surface wall 32 in order to provide a smooth transition between the plasterboard 21 and the distal end 35 of the rear surface wall 32. However, in an alternative embodiment (not shown), only the front surface wall 30 (i.e. the surface wall closest to the front surface 20*a* of the wall structure 20) can be configured to be covered by the plaster layer 23.

In an embodiment, the plaster layer 23 can include plastering tape applied onto at least a section of the front and/or rear surface walls 30, 32 and a section of the corresponding plasterboard 21, under the plastering material, in order to favor bonding of the plastering material and a smooth transition between the plasterboard 21 and the front and/or rear surface walls 30, 32.

In an embodiment, in order to favor bonding between the front and rear surface walls 30, 32 and the plaster layer 23 applied thereon, at least a section of each one of the front and rear surface walls 30, 32 has a serrated outer surface. In the embodiment shown, the entire length of each one of the front and rear surface walls 30, 32 has the above-mentioned serrated outer surface. In an embodiment, each depression between the projections defining the serrated outer surface of the front and rear surface walls 30, 32 includes edges extending at about 90° to one another, but one skilled in the art will understand that, in an alternative embodiment other configurations providing the overall serrated profile can be provided.

Referring to FIGS. 2 to 4, in the embodiment shown, each one of the front and rear surface wall 30, 32 is divided into a stud adjacent section 30*a*, 32*a* and a door adjacent section 30*b*, 32*b*. In the embodiment shown, the stud adjacent sections 30*a*, 32*a* and door adjacent sections 30*b*, 32*b* are contiguous to one another and together define the front and rear surface walls 30, 32 respectively. In the embodiment shown, each one of the stud adjacent sections 30*a*, 32*a* intersects at one end with the stud facing wall 13 of the frame body 12, while each one of the door adjacent sections 30*b*, 32*b* intersects at one end with the door facing wall 15 of the frame body 12. Hence, the stud adjacent sections 30*a*, 32*a* are positioned closer to the stud facing wall 13 than the door adjacent sections 30*b*, 32*b*.

In an embodiment, the door adjacent section 30*b*, 32*b*, is positioned slightly outwardly with respect to the stud adjacent section 30*a*, 32*a* (i.e. the stud adjacent section 30*a*, 32*a* is recessed with respect to the corresponding door adjacent section 30*b*, 32*b*). In an embodiment, the door adjacent section 30*b*, 32*b*, is positioned outwardly with respect to the stud adjacent section 30*a*, 32*a* of between about 1 and about 5 millimeters. More precisely, in an embodiment, the door adjacent section 30*b*, 32*b*, is positioned outwardly with respect to the stud adjacent section 30*a*, 32*a* of between about 2 and about 3 millimeters. One skilled in the art will understand that, in an alternative embodiment, intermediate section(s) can be provided between the stud adjacent section 30*a*, 32*a* and the door adjacent section 30*b*, 32*b*, each intermediate section being positioned outwardly with respect to an adjacent section positioned closer to the stud facing wall 13.

In the embodiment shown, a front lip 33*a* projects outwardly from the front surface wall 30. The front lip 33*a* is provided at a distal end 31 of the front surface wall 30 (i.e. at a junction of the front surface wall 30 with the door facing wall 15 in the embodiment shown). In the embodiment shown, a rear lip 33*b* also projects outwardly from the rear surface wall 32. The rear lip 33*b* is provided at the distal end 35 of the rear surface wall 32 (i.e. at a junction of the rear surface wall 32 with the door facing wall 15 in the embodiment shown). One skilled in the art will understand that, in an alternative embodiment (not shown), the frame body 12 can include only a front lip 33*a*.

In view of the above and as can be better seen in FIG. 2, the succession of the lip 33*a*, 33*b*, the door adjacent section 30*b*, 32*b* and the stud adjacent section 30*a*, 32*a* results in a structure gradually tapering down from the lip 33*a*, 33*b* towards the corresponding plasterboard 21. Such tapering favours easy application of the plaster layer 23 (i.e. a thin layer tapering down from the lip 33*a*, 33*b* towards the corresponding plasterboard 21). In other words, the succession of the stud adjacent section 30*a*, 32*a*, door adjacent section 30*b*, 32*b*, and the lip 33*a*, 33*b* allows a gradual widening of the frame body 12 between the stud facing wall 13 and the door facing wall 15, thereby limiting the thickness of plastering material in the plaster layer 23 to provide the desire smooth appearance over the front and rear surface walls 30, 32 of the structural frame 10 and facilitating the application of the plaster layer 23. In an embodiment where the plaster layer includes plastering tape, the combination of the stud adjacent section 30*a*, 32*a*, door adjacent section 30*b*, 32*b*, and the lip 33 can help accommodating the thickness of the plastering tape along the corresponding section of the front and rear surface walls 30, 32.

In the embodiment shown in FIGS. 1 to 4, a door receiving recess 34 is defined in the door facing wall 15, from the junction of one of the front and rear surface walls 30, 32 and the door facing wall 15. In other words, in the embodiment shown, the door facing wall 15 includes an un-recessed section 15*b* and a recessed section 15*a* defining the door receiving recess 34 (i.e. being recessed with respect to the un-recessed section 15*b* of the door facing wall 15). The one of the front and rear surface walls 30, 32 located at the junction of the recessed section 15*a* of the door facing wall 15 is shorter in length than the other one of the surface walls 30, 32. A connecting wall 34*b* also extends between the un-recessed section 15*b* of the door facing wall 15 and the recessed section 15*a* thereof and defines the door receiving recess 34 in combination with the recessed section 15*a*.

More particularly, in the embodiment shown, the door receiving recess 34 is defined in the door facing wall 15, from the junction of the recessed section 15*a* of the door facing wall 15 and the front surface wall 30 (i.e. the one of the front and rear surface walls 30, 32 with which the flush wall door 24 is substantially flush, when configured in a closed configuration).

As mentioned above, the door receiving recess 34 is sized and shaped to receive a portion of the door 24 therein, with the front surface 24*a* of the door 24 being substantially evenly levelled with the front surface 20*a* of the wall structure 20. In the embodiment shown, the front surface wall 30 is shorter than the rear surface wall 32, such that the door receiving recess 34 is opened (or positioned, or accessible) towards the front surface wall 30, with the connecting wall 34*b* being spaced apart from the front surface wall 30. When the door is configured in the closed configuration, the hinge portion, the latch portion and the top portion of the door 24 are respectively received in the door engaging recess 34 of the hinge side structural frame section 10*a*, the latch side structural frame section 10*b* and the top structural frame section 10*c* of the structural frame 10.

Referring to FIGS. 1 and 2, the door 24 is pivotally connected to the door facing wall 15 of the hinge side structural frame section 10*a*, in the door receiving recess, through concealed-type hinges 25 which allow the pivoting of the door 24 between the closed configuration (shown in FIG. 2) and the open configuration (shown in FIG. 1), without being exposed when the door 24 is configured in the closed configuration.

As can be seen in FIGS. 1 to 4, in an embodiment, at least the hinge side structural frame section 10*a* also includes a hinge engagement support 40 engageable with a hinge 25 of the hinged door 24. The hinge engagement support 40 is positioned between the stud facing wall 13 and the door facing wall 15, along at least a portion of the door engaging recess 34. More particularly, in the embodiment shown, the hinge engagement support 40 is positioned between the stud facing wall 13 and the recessed section 15*a* of the door facing wall 15, along the door engaging recess 34. The hinge engagement support 40 is configured to engage with the hinge 25 of the hinged door 24, received in the frame body 12, from the door facing wall 15. The hinge engagement support 40 is further configured to support the hinge 25 of the hinged door 24 when the hinge is secured thereto. In other words, the hinge engagement support 40 is sufficiently strong and sturdy to support the weight of the hinge 25 and the corresponding hinged door 24, when the hinge 25 is fastened to the hinge engagement support 40. In the embodiment shown, the hinge engagement support 40 extends between the front surface wall 30 and an intermediate wall 42 extending between the stud facing wall 13 and the door facing wall 15 and positioned between the front surface wall 30 and the rear surface wall 32. One skilled in the art will however understand that, in alternative embodiments, the hinge engagement support 40 can extend between different sections of the frame body 12, such as between the front surface wall 30 and the rear surface wall 32.

In the embodiment shown, the hinge engagement support 40 has two fastener receiving cavities 44 defined therein for receiving the fasteners. One skilled in the art will however understand that, in an alternative embodiment (not shown), a different amount of fastener receiving cavities 44, or no fastener receiving cavity 44, could be defined.

In order to lower manufacturing costs, in an embodiment, the latch side structural frame section 10*b* and top structural frame section 10*c* can also include the hinge engagement support 40, even though no hinge is mounted to these frame sections. In other words, in an embodiment, all the sections of the structural frame 10 have a similar configuration in order to prevent having to manufacture sections with different configurations. One skilled in the art will however understand that, in an alternative embodiment, only the hinge side structural frame section 10*a* can include the hinge engagement support 40, the latch side structural frame section 10*b* and top structural frame section 10*c* being free of hinge engagement support 40.

In an embodiment, the respective sections 10*a*, 10*b* of the structural frames 10 include appropriate apertures (not shown) for respectively receiving the hinges 25 and/or door latch (not shown).

Figure 6:
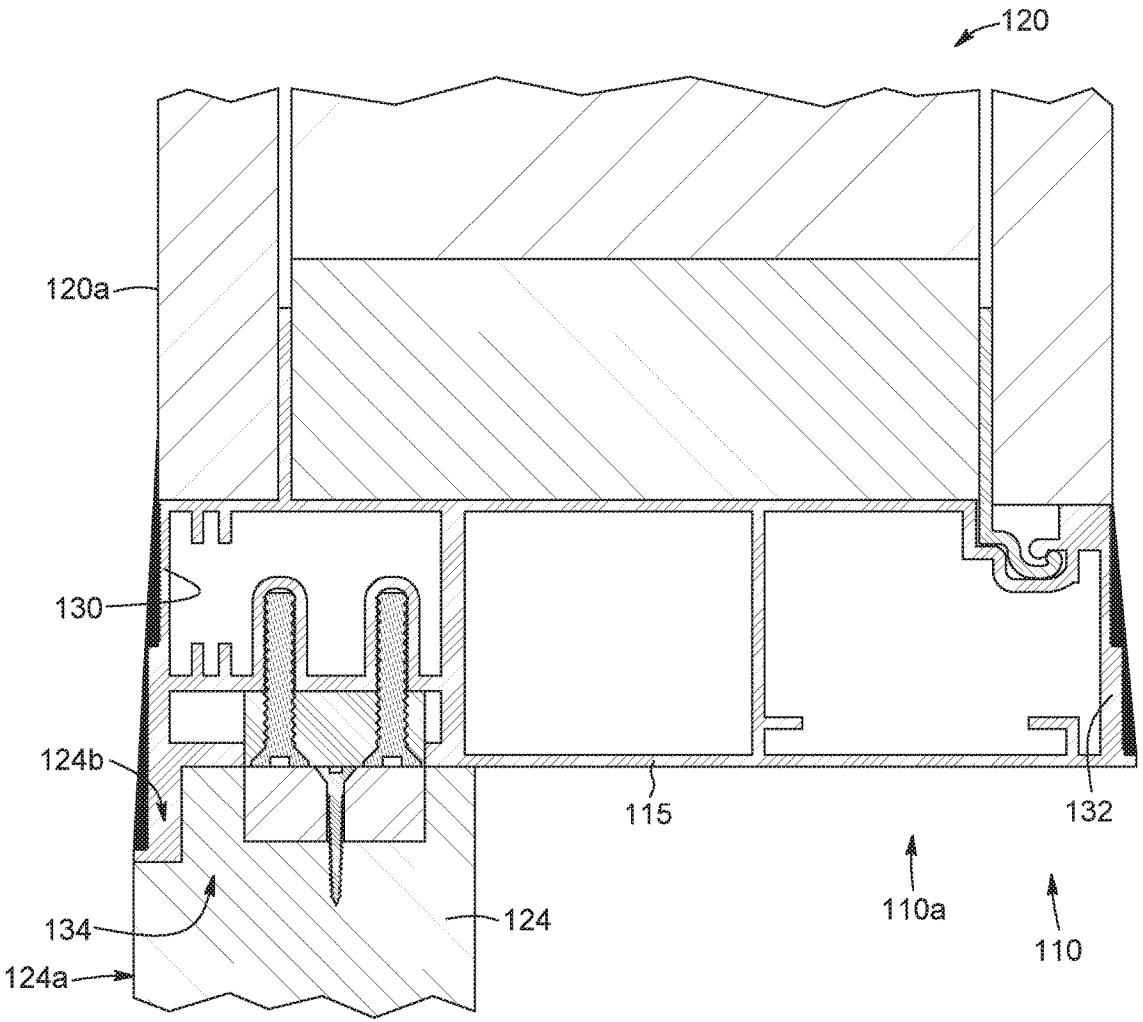
FIG. 6 is a cross-sectional view of a hinge side structural frame section of the concealable structural frame, shown mounted to a wall structure and with the hinged door connected thereto, in the closed configuration, in accordance with the embodiment where the concealable structural frame includes stud engaging walls spaced apart from one another and where the door opens inwardly.
Figure 7:
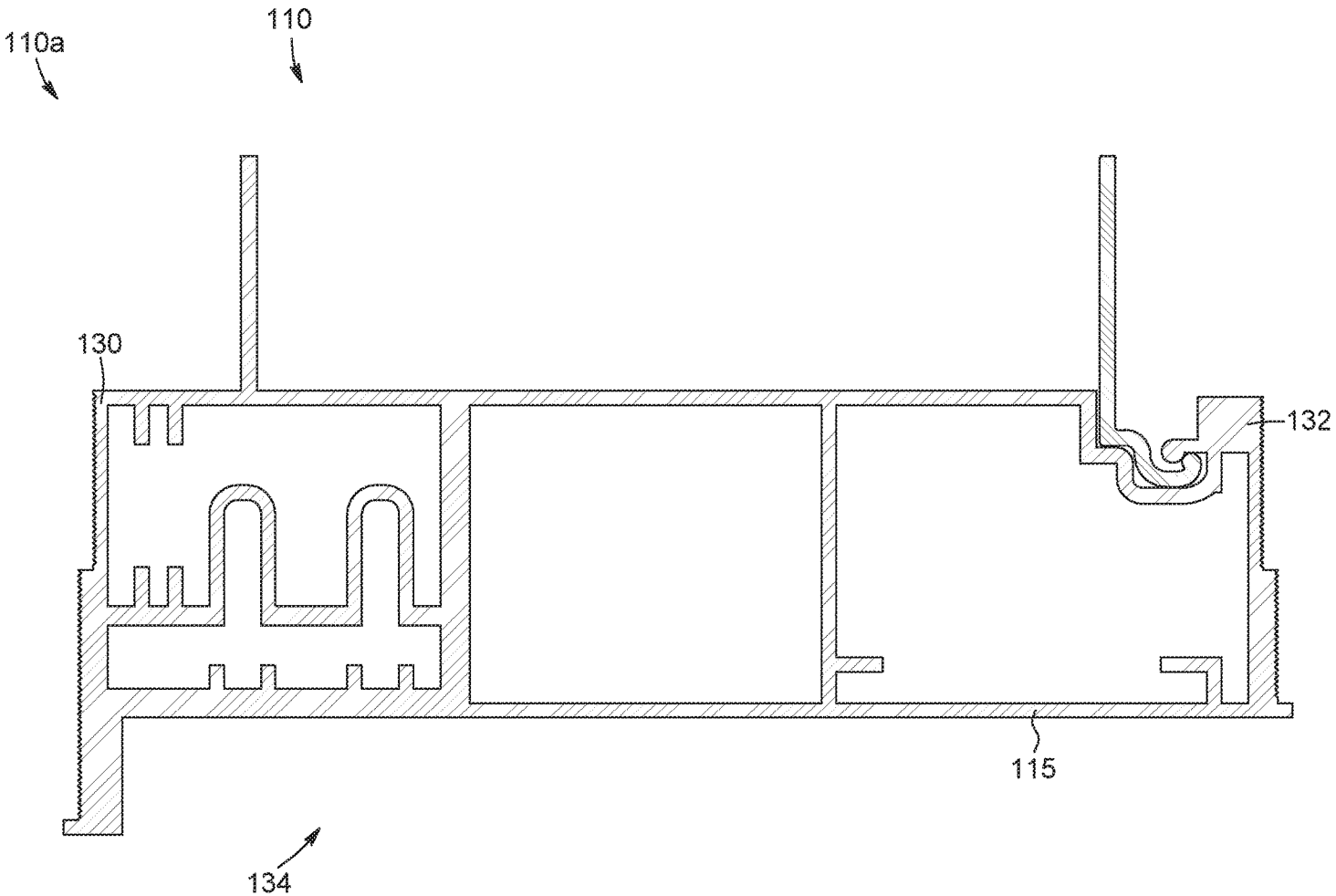
FIG. 7 is a cross-sectional view of the hinge side structural frame section of the concealable structural frame shown in FIG. 6.

Referring now to FIGS. 6 and 7, there is shown an alternative embodiment of the structural frame 110 for mounting a hinged door 124 opening inwardly (i.e. towards the inside, as a user pushes on the hinged door 124 from the front surface 20*a* of the drywall structure 20), substantially flush to a drywall structure 120, in accordance with an embodiment, wherein similar features are numbered using the same reference numerals in the 100 series. The structural frame 110 is substantially similar to the above described structural frame 10 of FIGS. 1 to 4, but includes a door receiving recess 134 with a different configuration than the above described structural frame 10 of FIGS. 1 to 4. Hence, not all components of the structural frame 110 are repeated below (i.e. components similar to those of the embodiment of FIGS. 1 to 4 and described above are not necessarily discussed below) and not all corresponding reference numbers of FIGS. 1 to 4 have been reproduced in FIGS. 6 and 7. One skilled in the art will understand that the above description of the components of the structural frame 10 of the embodiment of FIGS. 1 to 4 apply to similar components of the structural frame 110 of the present embodiment, even though not expressly discussed.

FIGS. 6 and 7 again show the hinge side structural frame section 110*a* of the frame 110, but one skilled in the art will understand that the teachings of the present description substantially apply to the latch side structural frame section (not shown) and top structural frame section (not shown) as well.

In the embodiment shown in FIGS. 6 and 7, the door receiving recess 134 is again defined at a junction of one of the front and rear surface walls 130, 132 and the door facing wall 115. However, in this alternative embodiment, the door receiving recess 134 is defined at the junction of the door facing wall 115 and the rear surface wall 132 (i.e. the one of the front and rear surface walls 130, 132, opposed to the surface wall 130, 132 with which a surface of the flush wall door 124 is substantially flush when configured in a closed configuration). In this embodiment, the door facing wall 115 includes a single section (i.e. the door facing wall 115 does not include an un-recessed section and a recessed section). One skilled in the art will however understand that, in alternative embodiments, the door facing wall 115 could include an un-recessed section and a recessed section. The rear surface wall 132 is shorter in length than the front surface wall 130, with the front surface wall 130 extending past the door facing wall 115. Hence, in this embodiment, the door receiving recess 134 is defined by a combination of the door facing wall 115 and a portion of the front surface wall 130 extending past the door facing wall 115.

In this alternative embodiment, the door receiving recess 134 is wider than a thickness of the door 124, as it extends along a substantial portion of the length of the door facing wall 115, and faces away from the front surface wall 130. In this embodiment, the flush wall door 124 includes a recessed section 124*b* sized and shaped to receive a portion of the structural frame 110 therein, with the front surface 124*a* of the door 124 being substantially evenly levelled with the front surface 120*a* of the wall structure 120, when configured in the closed configuration.

Figure 8:
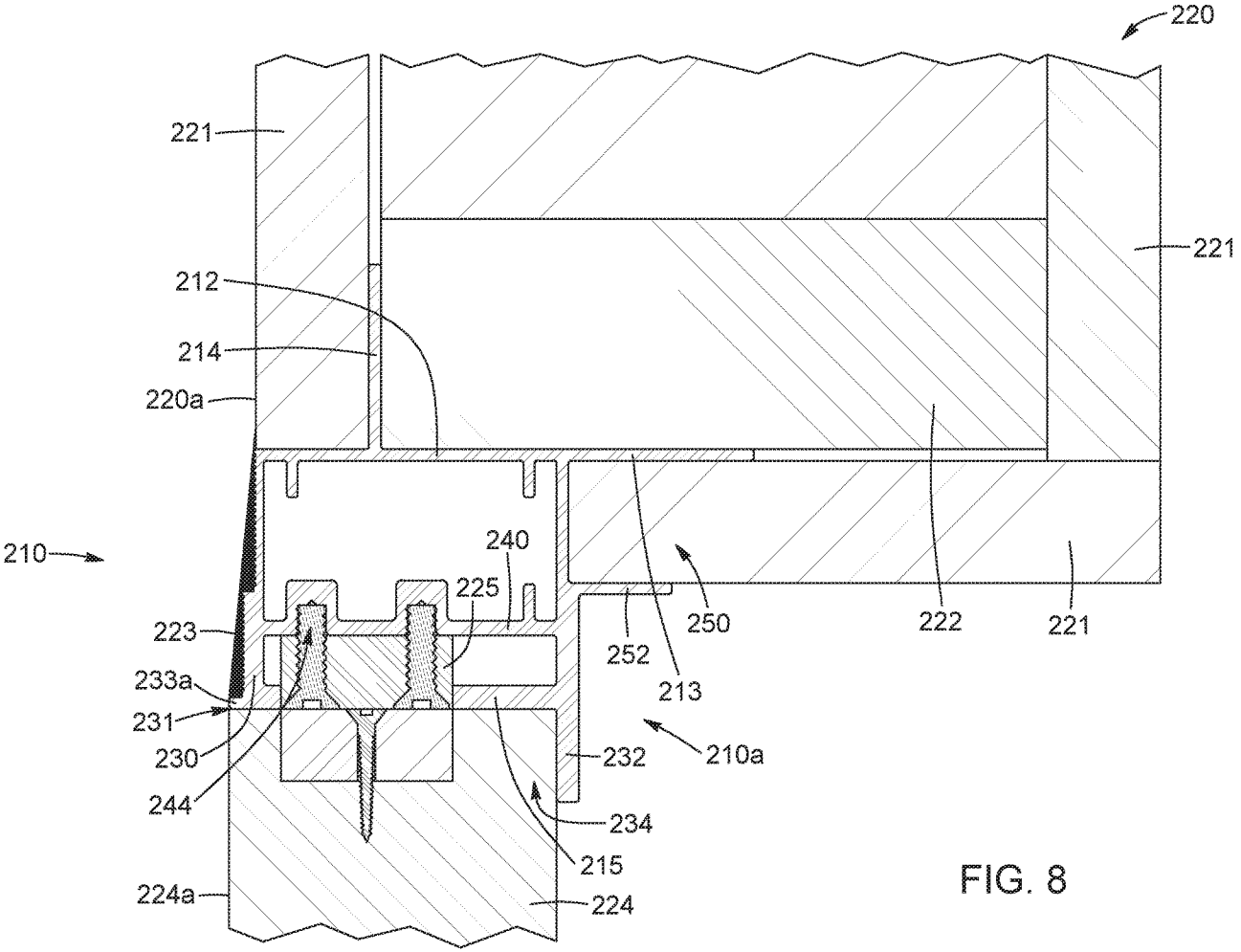
FIG. 8 is a cross-sectional view of the hinge side structural frame section of the concealable structural frame, shown mounted to a wall structure and with the hinged door connected thereto, in the closed configuration, in accordance with an embodiment where the concealable structural frame includes a single stud engaging wall and where the door opens outwardly.
Figure 9:
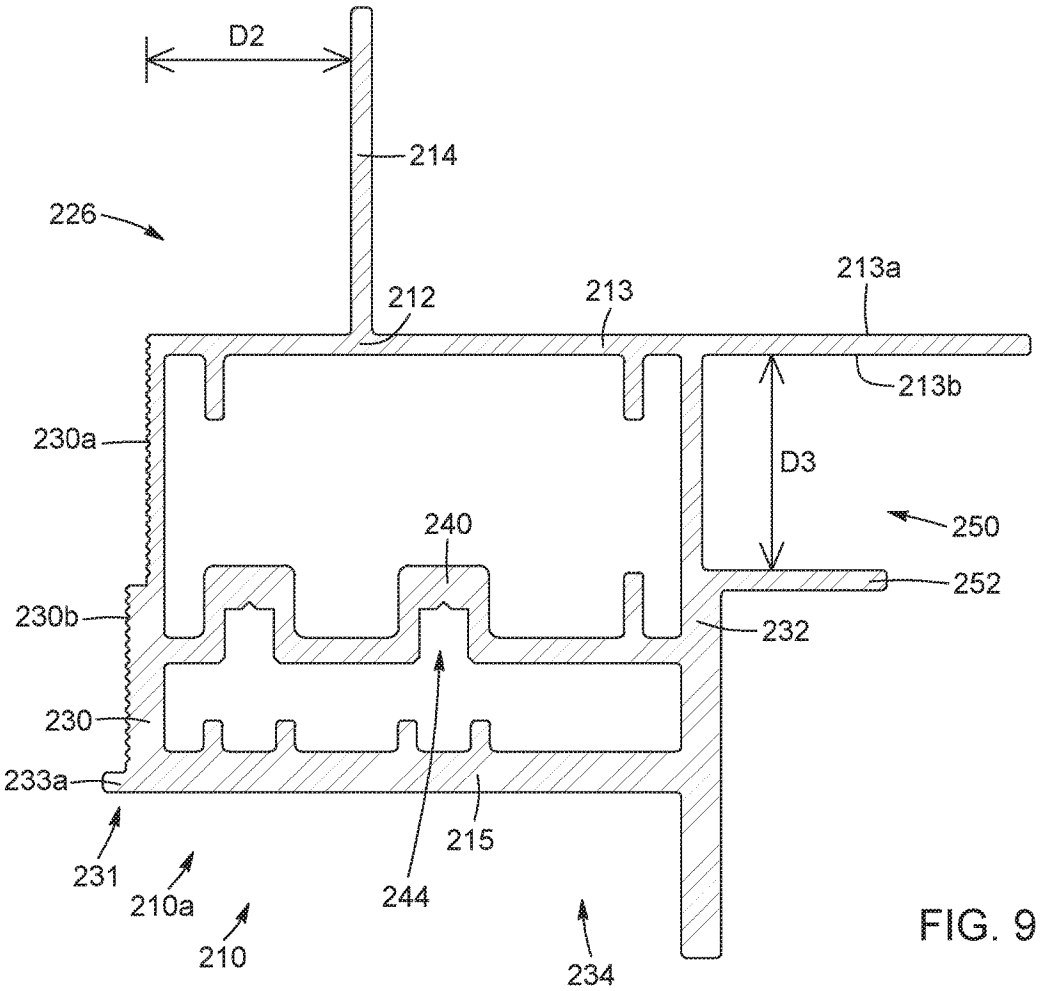
FIG. 9 is a cross-sectional view of the hinge side structural frame section of the concealable structural frame shown in FIG. 8.

Referring now to FIGS. 8 and 9, there is shown an alternative embodiment of the structural frame 210 for mounting a hinged door 224 opening outwardly (i.e. towards the outside, as a user pulls on the hinged door 124 from the front surface 20*a* of the drywall structure 20), substantially flush to a drywall structure 220, wherein similar features are numbered using the same reference numerals in the 200 series. Once again, FIGS. 8 and 9 show the hinge side structural frame section 210*a* of the frame 210, but one skilled in the art will understand that the teachings of the present description substantially apply to the latch side structural frame section (not shown) and top structural frame section (not shown) as well.

In this alternative embodiment, the concealable structural frame 210 includes a frame body 212 with a stud facing wall 213, a door facing wall 215, spaced-apart from the stud facing wall 213, and a single stud engaging wall 214 extending outwardly from an outwardly facing surface 213*a* of the stud facing wall 213. The frame body 212 also includes front and rear surface walls 230, 232 extending between the stud facing wall 213 and the door facing wall 215. The stud engaging wall 214 is once again spaced apart (or recessed inwardly) from the front surface wall 230 of a distance D2 substantially similar to the thickness of the plasterboards 221 of the wall structure 220, thereby defining a plasterboard receiving recess 226.

Once again, in this alternative embodiment, the concealable structural frame 210 can be inserted into an aperture (not shown) in a previously fabricated wall structure 220, from one side, until the stud engaging wall 214 engages a surface of the stud 222 of the wall structure 220. Subsequently to the insertion, the stud engaging wall 214 and the stud facing wall 213 can be fastened to the stud 222 of the wall structure 220, using known fasteners (not shown) such as, nails, screws, or the like. Indeed, in this alternative embodiment, in order to secure the structural frame 210 to the wall structure 220, the stud engaging wall 214 and the stud facing wall 213 are secured to the stud 222.

In order to provide the desired flush wall appearance of the combined drywall structure 220, structural frame 210 and door 224, along the front surface 220*a* of the wall structure 220 and the front surface 224*a* of the door 224, the structural frame 210 is configured to receive a plaster layer 223 over the front surface wall 230 to provide a smooth transition between the plasterboard 221 and the distal end 231 of the front surface wall 230. To that effect, the front surface wall 230 of the structural frame 210 is similar to the front surface wall 30, 130 of the structural frames 10, 110 described above in connection with the embodiments of FIGS. 1 to 7, and the above teachings therefore apply to the front surface wall 230 of the present embodiment.

Hence, in the embodiment shown, at least a section of the front surface wall 230 has a serrated outer surface to favor bonding between the front surface wall 230 and the plaster layer 223. Moreover, the front surface wall 230 is divided into a stud adjacent section 230*a* and a door adjacent section 230*b*. The stud adjacent section 230*a* intersects at one end with the stud facing wall 213 of the frame body 212 and is positioned closer to the stud facing wall 213 than the door adjacent section 230*b*. Once again, the door adjacent section 230*b* can be positioned slightly outwardly with respect to the stud adjacent section 230*a*. In the embodiment shown, a front lip 233*a* also projects outwardly from the front surface wall 230, at the distal end 231 thereof.

The frame 210 also includes a door receiving recess 234 defined by the door facing wall 215, similarly to the door receiving recess 34 of the embodiment of FIGS. 1 to 4. The door receiving recess 234 is sized and shaped to receive a portion of the door 224 therein, with the front surface 224*a* of the door 224 substantially evenly levelled with the front surface 220*a* of the wall structure 220. In the embodiment shown, the front surface wall 230 is shorter than the rear surface wall 232, such that the door engaging recess 234 is opened towards the front surface wall 230. In the embodiment, shown, the door receiving recess 234 is defined by a combination of the door facing wall 215 and a portion of the rear surface wall 232 extending past the door facing wall 215. In the embodiment shown, the door facing wall 215 includes a single section (i.e. the door facing wall 215 does not include an un-recessed section and a recessed section). One skilled in the art will however understand that, in an alternative embodiment, the door facing wall 215 can include an un-recessed section and a recessed section.

Once again, the door 224 is pivotally connectable to the door facing wall 215 of the hinge side structural frame section 210*a* through concealed-type hinges 225 which allow the pivoting of the door 224 between the closed configuration (shown in FIG. 8) and an open configuration (not shown), without being exposed when the door 224 is configured in the closed configuration. Once again, at least the hinge side structural frame section 210*a* includes a hinge engagement support 240 positioned between the stud facing wall 213 and the door facing wall 215, along at least a portion of the door engaging recess 234 and engageable with the hinge 225 of the hinged door 224. In this alternative embodiment, the hinge engagement support 240 extends between the front surface wall 230 and the rear surface wall 232. Once again, the hinge engagement support 240 has two fastener receiving cavities 244 defined therein, but one skilled in the art will understand that a different amount of fastener receiving cavities 244, or no fastener receiving cavity 244, could be defined. It will also be understood that the door facing wall 215 of the hinge side structural frame section 210*a* can include appropriate apertures (not shown) for receiving the hinges 225 and allowing engagement with the hinge engagement support 240.

In this alternative embodiment, the frame body 212 also includes a plasterboard receiving cavity 250, for receiving a portion of a plasterboard 221 lining the stud facing wall 213, along an inwardly facing surface 213*b* thereof. The plasterboard receiving cavity 250 is defined by the combination of a portion of the stud facing wall 213, a portion of the rear surface wall 232 and a rear projection 252 projecting outwardly from the rear surface wall 232 and spaced apart from the stud facing wall 213. The plasterboard receiving cavity 250 is opened rearwardly and has a width D3, which is substantially similar to the thickness of the plasterboard 221 of the drywall structure 220 lining the stud facing wall 213, along the inwardly facing surface 213*b* thereof. In the embodiment shown, the width D3 of the plasterboard receiving cavity 250 is substantially similar to the distance D2 which the stud engaging wall 214 is spaced apart (or recessed inwardly) from the front surface wall 230, but one skilled in the art will understand that, in an alternative embodiment, they could also be different, for example to receive plasterboards 221 of different thicknesses or a different amount of plasterboards 221.

The plasterboard receiving cavity 250 allows a portion of the plasterboard 221 lining the stud facing wall 213 along an inwardly facing surface 213*b* thereof to be received therein, thereby resulting in no necessary plastering between the plasterboard 221 and the rear surface wall 232, while still providing an aesthetically pleasing look. Hence, the plasterboard receiving cavity 250 eases the installation of the structural frame 210 while providing the concealable features of the frame 210.

Figure 10:
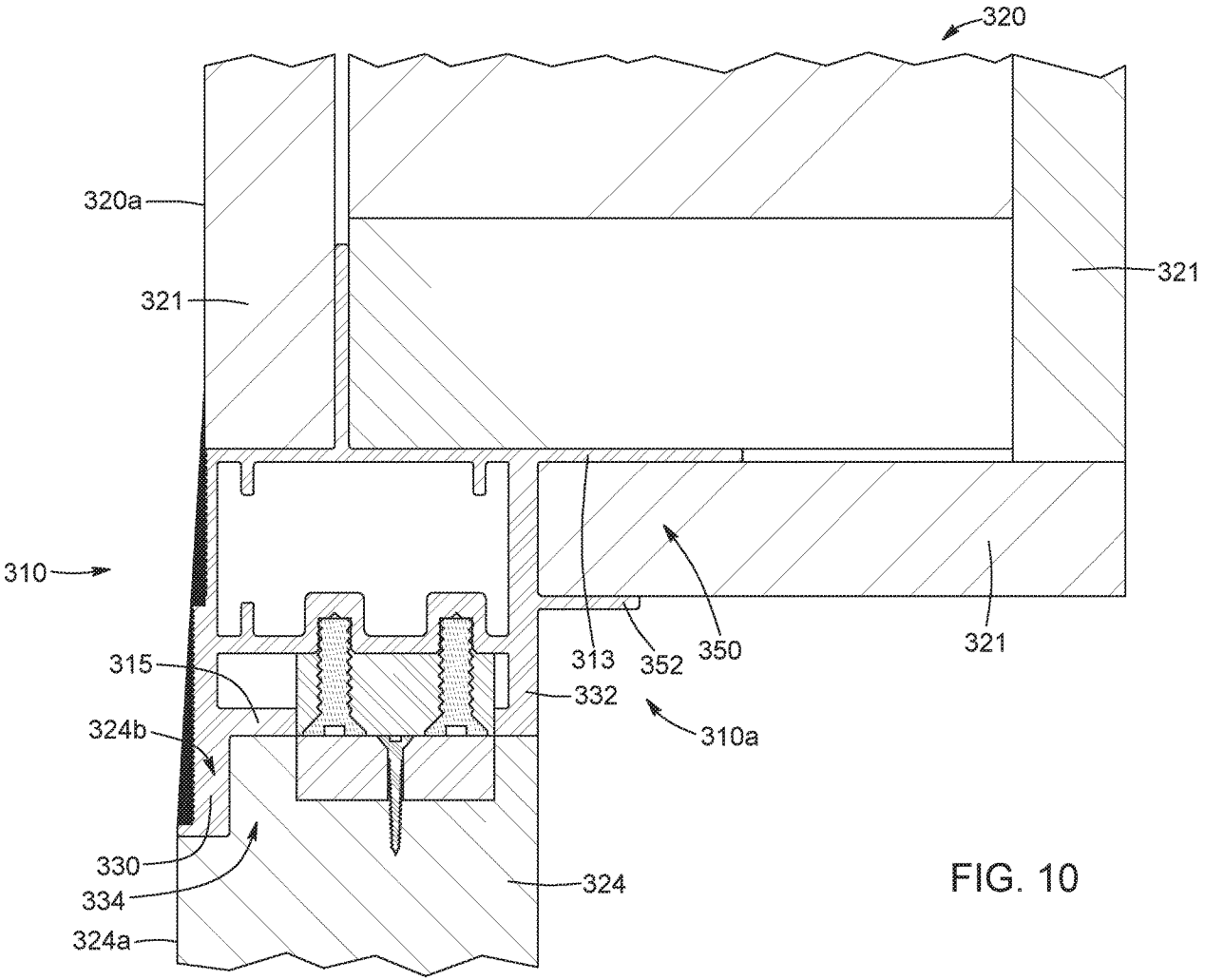
FIG. 10 is a cross-sectional view of the hinge side structural frame section of the concealable structural frame, shown mounted to a wall structure and with the hinged door connected thereto, in the closed configuration, in accordance with the embodiment where the concealable structural frame includes a single stud engaging wall and where the door opens inwardly.
Figure 11:
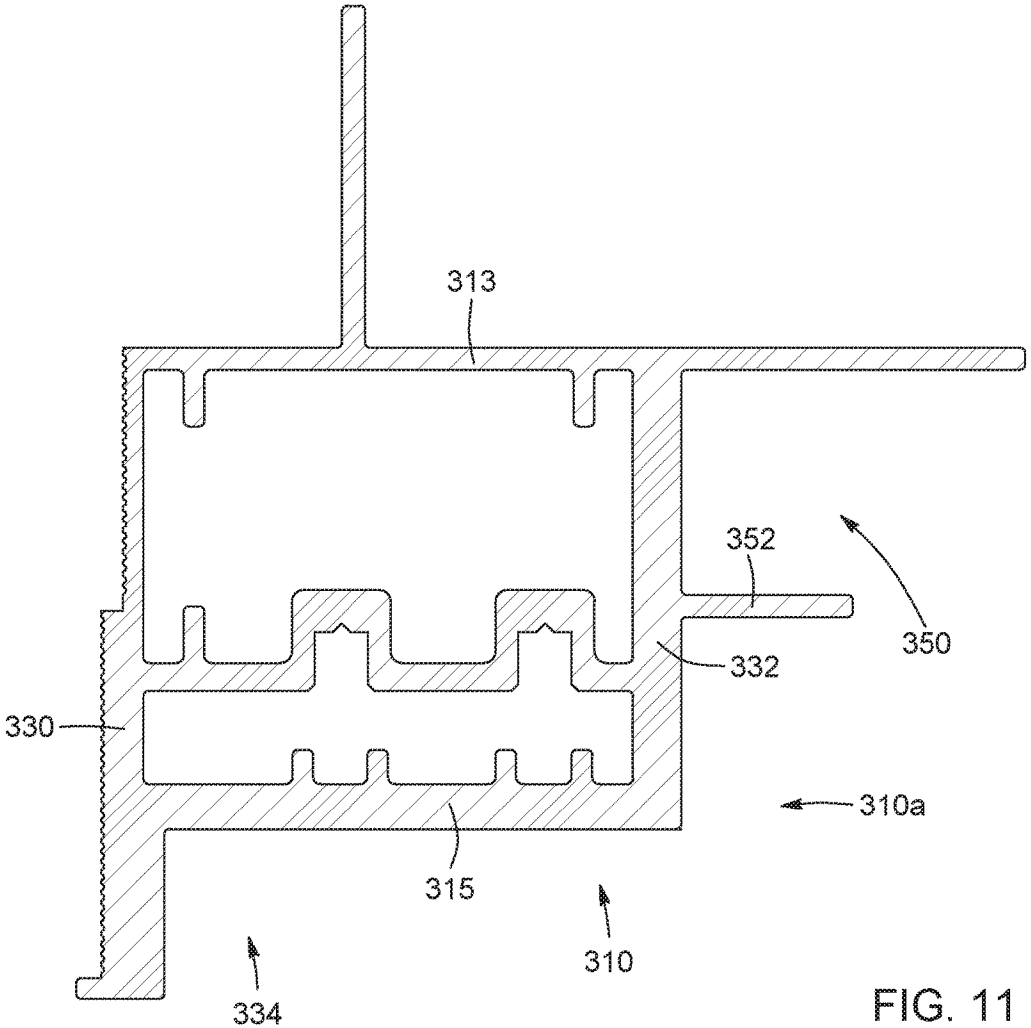
FIG. 11 is a cross-sectional view of the hinge side structural frame section of the concealable structural frame shown in FIG. 10.

Referring now to FIGS. 10 and 11, there is shown an alternative embodiment of the structural frame 310 for mounting a hinged door 324 opening inwardly (i.e. towards the inside, as a user pushes on the hinged door 324 from the front surface 20*a* of the drywall structure 20), substantially flush to a drywall structure 320, in accordance with an embodiment, wherein similar features are numbered using the same reference numerals in the 300 series. The structural frame 310 is substantially similar to the above described structural frame 210 of FIGS. 8 and 9, but includes a door receiving recess 334 with a different configuration than the above described structural frame 210 of FIGS. 8 and 9. Hence, not all components of the structural frame 310 are repeated below (i.e. components similar to those of the embodiment of FIGS. 8 and 9 and described above are not necessarily discussed below) and not all corresponding reference numbers of FIGS. 8 and 9 have been reproduced in FIGS. 10 and 11. One skilled in the art will understand that the above description of the components of the structural frame 210 of the embodiment of FIGS. 8 and 9 apply to similar components of the structural frame 310 of the present embodiment, even though not expressly discussed.

FIGS. 10 and 11 again show the hinge side structural frame section 310*a* of the frame 310, but one skilled in the art will understand that the teachings of the present description substantially apply to the latch side structural frame section (not shown) and top structural frame section (not shown) as well.

In the embodiment shown in FIGS. 10 and 11, the door receiving recess 334 is defined by the door facing wall 315 and a portion of the front surface wall 330 extending past the door facing wall 315. Once again, the door receiving recess 334 is sized and shaped to receive a portion of the door 324 therein, with the front surface 324*a* of the door 324 substantially evenly levelled with the front surface 320*a* of the wall structure 320. In this embodiment, the front surface wall 330 is longer than the rear surface wall 332, such that the door engaging recess 334 is opened towards the rear surface wall 332. In the embodiment shown, the door receiving recess 334 is defined by a combination of the door facing wall 315 and a portion of the front surface wall 330 extending past the door facing wall 315. In this embodiment, the flush wall door 324 again includes a recessed section 324*b* sized and shaped to receive a portion of the structural frame 310 therein, with the front surface 324*a* of the door 324 being substantially evenly levelled with the front surface 320*a* of the wall structure 320, when configured in the closed configuration.

Once again, the frame body 312 also includes a plasterboard receiving cavity 350, for receiving a portion of a plasterboard 321 lining the stud facing wall 313 along an inwardly facing surface 313*b* thereof. The plasterboard receiving cavity 250 is again defined by the combination of a portion of the stud facing wall 313, a portion of the rear surface wall 332 and a rear projection projecting outwardly from the rear surface wall 332 and spaced apart from the stud facing wall 313.

Advantageously, the above described structural frame 10, 110, 210, 310 allows the mounting of a hinge-type door 24, 124, 224, 324 with the front surface 24*a*, 124*a*, 224*a*, 324*a* that lies substantially flush with the front surface 20*a*, 120*a*, 220*a*, 320*a* of the wall structure 20, 120, 220, 320 when in the closed configuration. The above described structural frame 10, 110, 210, 310 also allows the remaining gap around the edges of the door 24, 124, 224, 324 to be sufficiently narrow to provide a concealed door appearance when using concealed-type hinges and where cracking of the plaster in the vicinity of the door 24, 124, 224, 324 is substantially prevented by the structural frame 10, 110, 210, 310.

Several alternative embodiments and examples have been described and illustrated herein. The embodiments of the invention described above are intended to be exemplary only. A person skilled in the art would appreciate the features of the individual embodiments, and the possible combinations and variations of the components. A person skilled in the art would further appreciate that any of the embodiments could be provided in any combination with the other embodiments disclosed herein. It is understood that the invention may be embodied in other specific forms without departing from the central characteristics thereof. The present examples and embodiments, therefore, are to be considered in all respects as illustrative and not restrictive, and the invention is not to be limited to the details given herein. Accordingly, while specific embodiments have been illustrated and described, numerous modifications come to mind without significantly departing from the scope of the invention as defined in the appended claims.

The invention claimed is:

1. A concealable structural frame for mounting a hinged door flushed to a surface of a drywall structure including a wall stud and plasterboards having a thickness, the concealable structural frame comprising:

a unitary structural frame body including:

a stud facing wall having an outwardly facing surface engageable with a surface of the stud;

a door facing wall spaced apart from the stud facing wall, with a hollow space being defined between the stud facing wall and the door facing wall, the door facing wall including a door receiving recess at least partially defined by a section of the door facing wall;

a front surface wall at least partially extending between the stud facing wall and the door facing wall, the front surface wall being configured to receive a plaster layer thereon, for concealment thereof;

a rear surface wall at least partially extending between the stud facing wall and the door facing wall and spaced apart from the front surface wall;

a stud engaging wall projecting outwardly from the outwardly facing surface of the stud facing wall and being recessed inwardly from one of the front surface wall and the rear surface wall by a distance substantially similar to the thickness of the plasterboards to define a plasterboard receiving recess;

a hinge engagement support engageable with a hinge of the hinged door for supporting the hinge when the hinge is mounted thereto, the hinge engagement support being positioned within the hollow space defined between the stud facing wall and the door facing wall and extending along at least a portion of the door receiving recess of the door facing wall.

2. The concealable structural frame of claim 1, wherein the frame body comprises a hinge side structural frame section, a latch side structural frame section spaced apart from the hinge side structural frame section and a top structural frame section connecting the hinge side structural frame section and the latch side structural frame section at a top end thereof.

3. The concealable structural frame of claim 1, wherein the front surface wall comprises a door adjacent section and a stud adjacent section inwardly recessed with respect to the door adjacent section, the stud adjacent section being positioned closer to the stud engaging wall than the door adjacent section.

4. The concealable structural frame of claim 1, wherein the front surface wall includes a front lip extending outwardly at a distal end thereof.

5. The concealable structural frame of claim 1, wherein the frame body comprises two stud engaging walls spaced apart from one another of a distance substantially similar to the width of the stud, each one of the two stud engaging walls being recessed inwardly from a corresponding one of the front surface wall and the rear surface wall by a distance substantially similar to the thickness of the plasterboards to define a plasterboard receiving recess and at least one of the two stud engaging walls being removably connectable to the frame body.

6. The concealable structural frame of claim 5, wherein the at least one stud engaging wall removably connectable to the frame body includes a connecting end engageable to the stud facing wall, in a pivoting male-female configuration.

7. The concealable structural frame of claim 6, wherein the frame body comprises at least one engagement channel defined in the stud facing wall thereof, the at least one engagement channel and the connecting end of the at least one stud engaging wall removably connectable to the frame body having a complementary hook profile for each one of the at least one engagement channel to receive and securely engage the connecting end of a corresponding one of the at least one removably connectable stud engaging wall.

8. The concealable structural frame of claim 5, wherein the rear surface wall is configured to receive a plaster layer thereon, for concealment thereof.

9. The concealable structural frame of claim 8, wherein the rear surface wall comprises a door adjacent section and a stud adjacent section inwardly recessed with respect to the door adjacent section, the stud adjacent section being positioned closer to the stud engaging wall than the door adjacent section.

10. The concealable structural frame of claim 8, wherein the rear surface wall includes a rear lip extending outwardly at a distal end thereof.

11. The concealable structural frame of claim 1, wherein the stud facing wall comprises an inwardly facing surface and wherein the frame body further comprises a plasterboard receiving cavity configured to receive a portion of one of the plasterboards lining the stud facing wall along the inwardly facing surface thereof.

12. The concealable structural frame of claim 11, wherein the frame body further comprises a rear projection projecting outwardly from a rear surface of the rear surface wall and spaced apart from the stud facing wall of a distance substantially similar to the thickness of the one of the plasterboards lining the stud facing wall along the inwardly facing surface, the plasterboard receiving cavity being defined by a combination of a portion of the stud facing wall, a portion of the rear surface wall and the rear projection.

13. A flush wall door assembly for mounting a hinged door flushed to a surface of a drywall structure including a wall stud and plasterboards having a thickness, the flush wall door assembly comprising:

a unitary structural frame body including:

a stud facing wall having an outwardly facing surface engageable with a surface of the stud;

a door facing wall spaced apart from the stud facing wall, with a hollow space being defined between the stud facing wall and the door facing wall, the door facing wall comprising a door receiving recess at least partially defined by a section of the door facing wall;

a front surface wall at least partially extending between the stud facing wall and the door facing wall, the front surface wall being configured to receive a plaster layer thereon, for concealment thereof;

a rear surface wall at least partially extending between the stud facing wall and the door facing wall and spaced apart from the front surface wall;

a stud engaging wall projecting outwardly from the outwardly facing surface of the stud facing wall and being recessed inwardly from one of the front surface wall and the rear surface wall by a distance substantially similar to the thickness of the plasterboard to define a plasterboard receiving recess; and a hinge engagement support positioned within the hollow space defined between the stud facing wall and the door facing wall and extending along at least a portion of the recessed section of the door facing wall;

a door hingedly connectable to the door facing wall of the frame body, along the door receiving recess; and concealed type hinges being engageable between the door and the frame body, the concealed type hinges being securable to the hinge engagement support of the frame body and being supported by the hinge engagement support of the frame body when secured thereto.

14. The flush wall door assembly of claim 13, wherein the front surface wall of the frame body comprises a door adjacent section and a stud adjacent section inwardly recessed with respect to the door adjacent section, the stud adjacent section being positioned closer to the stud engaging wall than the door adjacent section.

15. The flush wall door assembly of claim 13, wherein the front surface wall includes a front lip extending outwardly at a distal end thereof.

16. The flush wall door assembly of claim 13, wherein the frame body comprises two stud engaging walls spaced apart from one another of a distance substantially similar to the width of the studs, each one of the two stud engaging walls being recessed inwardly from one of the front surface wall and the rear surface wall by a distance substantially similar to the thickness of the plasterboard to define a plasterboard receiving recess and at least one of the two stud engaging walls being removably connectable to the frame body.

17. The flush wall door assembly of claim 16, wherein the at least one stud engaging wall removably connectable to the frame body includes a connecting end engageable to the stud facing wall, in a pivoting male-female configuration.

18. The flush wall door assembly of claim 17, wherein the frame body comprises at least one engagement channel defined in the stud facing wall thereof, the at least one engagement channel and the connecting end of the at least one stud engaging wall removably connectable to the frame body having a complementary hook profile for each one of the at least one engagement channel to receive and securely engage the connecting end of a corresponding one of the at least one removably connectable stud engaging wall.

19. The flush wall door assembly of claim 16, wherein the rear surface wall is configured to receive a plaster layer thereon, for concealment thereof.

20. The flush wall door assembly of claim 19, wherein the rear surface wall comprises a door adjacent section and a stud adjacent section inwardly recessed with respect to the door adjacent section, the stud adjacent section being positioned closer to the stud engaging wall than the door adjacent section.

21. The flush wall door assembly of claim 19, wherein the rear surface wall includes a rear lip extending outwardly at a distal end thereof.

22. The flush wall door assembly of claim 13, wherein the stud facing wall comprises an inwardly facing surface and wherein the frame body further comprises a plasterboard receiving cavity configured to receive a portion of one of the plasterboards lining the stud facing wall along the inwardly facing surface.

23. The flush wall door assembly of claim 22, wherein the frame further comprises a rear projection projecting outwardly from a rear surface of the rear surface wall and spaced apart from the stud facing wall of a distance substantially similar to the thickness of the one of the plasterboards lining the stud facing wall along the inwardly facing surface, the plasterboard receiving cavity being defined by a combination of the stud facing wall, a portion of the rear surface wall and the rear projection.

* * * * *